US009765602B2

(12) United States Patent
Smart et al.

(10) Patent No.: US 9,765,602 B2
(45) Date of Patent: Sep. 19, 2017

(54) FLOW RINGS FOR REGULATING FLOW IN AUTONOMOUS INFLOW CONTROL DEVICE ASSEMBLIES

(71) Applicant: Halliburton Energy Services, Inc., Houston, TX (US)

(72) Inventors: David Alexander Smart, Dallas, TX (US); William Ryan Huffer, Dallas, TX (US); Aaron Bonner, Flower Mound, TX (US); Jean Marc Lopez, Plano, TX (US); John Benjamin Cox, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 418 days.

(21) Appl. No.: 14/383,935

(22) PCT Filed: Nov. 14, 2013

(86) PCT No.: PCT/US2013/070010
§ 371 (c)(1),
(2) Date: Sep. 9, 2014

(87) PCT Pub. No.: WO2015/072993
PCT Pub. Date: May 21, 2015

(65) Prior Publication Data

US 2015/0337627 A1 Nov. 26, 2015

(51) Int. Cl.
*E21B 43/12* (2006.01)
*E21B 43/08* (2006.01)
(Continued)

(52) U.S. Cl.
CPC ..... *E21B 43/12* (2013.01); *E21B 34/14* (2013.01); *E21B 43/08* (2013.01); *E21B 43/086* (2013.01); *E21B 43/10* (2013.01)

(58) Field of Classification Search
CPC ..... E21B 34/12; E21B 43/086; E21B 43/10; E21B 34/14; E21B 43/12; E21B 43/08
See application file for complete search history.

(56) References Cited

U.S. PATENT DOCUMENTS 5,881,809 A 3/1999 Gillespie et al.
2008/0041580 A1* 2/2008 Freyer ..... E21B 34/08 166/193

(Continued)

FOREIGN PATENT DOCUMENTS

WO 2015072993 A1 5/2015

OTHER PUBLICATIONS

International Search Report and Written Opinion for PCT/US2013/070010 dated Aug. 1, 2014.

*Primary Examiner* — Blake Michener
(74) *Attorney, Agent, or Firm* — McDermott Will & Emery LLP

(57) ABSTRACT

Disclosed are wellbore flow control devices that allow on-site field adjustments to flow characteristics. One autonomous inflow control device (AICD) assembly includes a base pipe defining one or more flow ports and an interior, a first end ring and a second end ring each arranged about the base pipe, the second end ring being axially-offset from the first end ring such that a fluid compartment is defined therebetween, an AICD arranged within the fluid compartment and having at least one fluid inlet and an outlet configured to be in fluid communication with one of the one or more flow ports, and a flow ring arranged about the base pipe and in fluid communication with the AICD, the flow ring being operable to regulate a fluid flow into the interior of the base pipe and being accessible and manipulatable by a well operator on-site.

15 Claims, 5 Drawing Sheets

(51) Int. Cl.
*E21B 34/14* (2006.01)
*E21B 43/10* (2006.01)

(56) References Cited

U.S. PATENT DOCUMENTS

| | | | |
|---|---|---|---|
| 2008/0217001 | A1 | 9/2008 | Dybevik et al. |
| 2008/0283238 | A1 | 11/2008 | Richards et al. |
| 2011/0297385 | A1 | 12/2011 | Dykstra et al. |
| 2013/0264072 | A1 | 10/2013 | Lopez et al. |

* cited by examiner

FLOW RINGS FOR REGULATING FLOW IN AUTONOMOUS INFLOW CONTROL DEVICE ASSEMBLIES

BACKGROUND

The present invention generally relates to wellbore flow control devices and, more specifically, to making on-site field adjustments to autonomous inflow control devices.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices (AICD) can be particularly advantageous in subterranean operations, since they are able to automatically regulate fluid flow without the need for operator control due to their design. In this regard, AICDs can be designed such that they provide a greater resistance to the flow of undesired fluids (e.g., gas and/or water) than they do desired fluids (e.g., oil), particularly as the percentage of the undesired fluids increases.

Several AICDs are often combined into an AICD system that can be manufactured to particular specifications and/or designs requested by well operators based on production needs for particular well sites. Such design specifications may include the required flow rate of fluids through the AICD system for normal operation. Upon receiving the AICD system at a well site, however, production needs for the well operator or a well site may have changed. For instance, the well operator may learn new information about the well which would necessitate an AICD system configured for different production capabilities. Alternatively, the well operator may desire to use the manufactured AICD system at a different well site where the production needs and/or capabilities are different. Accordingly, it may prove advantageous to have an AICD system that is adjustable on-site by the well operator.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention generally relates to wellbore flow control devices and, more specifically, to making on-site field adjustments to autonomous inflow control devices.

Disclosed are various ways for a well operator to make on-site adjustments to autonomous inflow control device assemblies prior to deployment downhole. The autonomous inflow control device may include a flow ring that may be manipulated by the well operator to thereby adjust the flow characteristics and how much fluid flow will be allowed during production operations. In some cases, the flow ring may be rotatable in order to strategically align flow channels in the flow ring with autonomous inflow control devices or autonomous inflow control device fluid compartments. In other cases, the flow channels may be sized to provide particular fluid flow capabilities for the flow ring. As a result, a well operator may have the ability to strategically adjust fluid flow capabilities of an autonomous inflow control device assembly in the field prior to its deployment.

As used herein, the term "on-site" refers to a rig location or field location where an autonomous inflow control device (AICD) system or assembly may be delivered and otherwise following its discharge from a manufacturer's facility. The term may also refer to any location that the AICD system or assembly might encounter or otherwise be located prior to being deployed downhole for operation.

Figure 1:
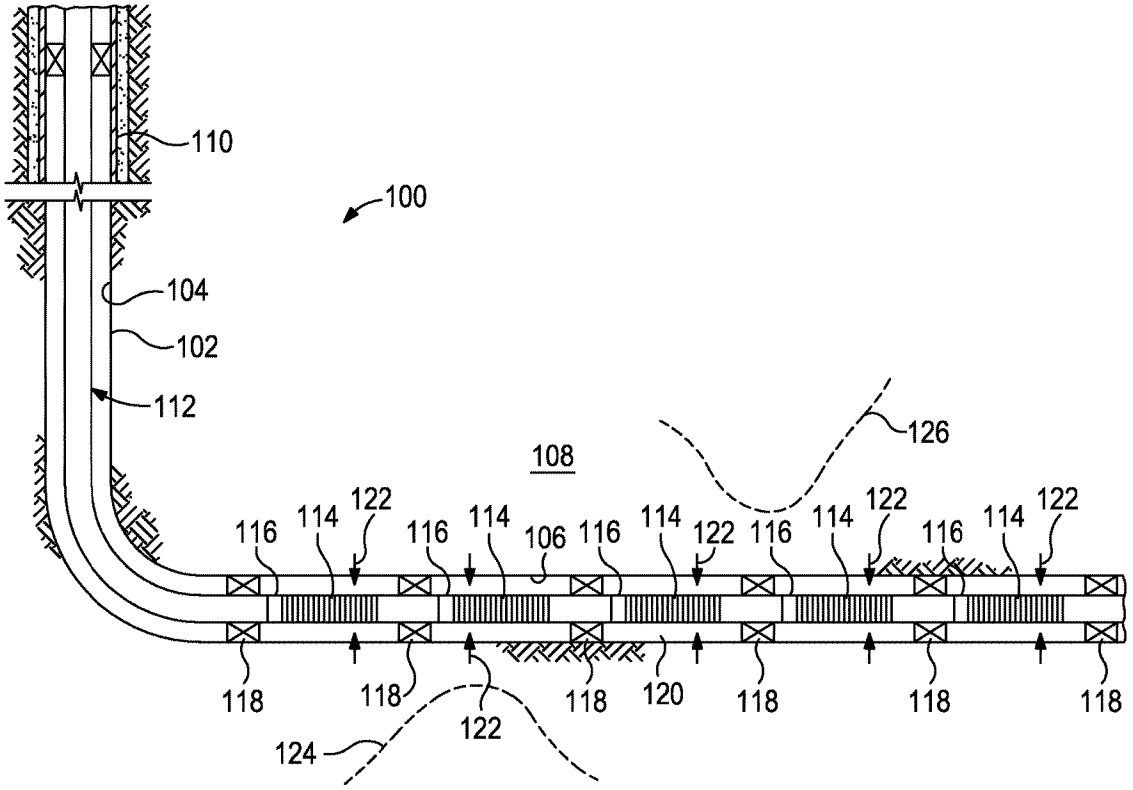
FIG. 1 illustrates a well system which can embody principles of the present disclosure, according to one or more embodiments.

Referring to FIG. 1, illustrated is a well system 100 which can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. The well screens 114 may be swell screens, wire wrap screens, mesh screens, sintered screens, expandable screens, pre-packed screens, treating screens, or other known screen types. In operation, the well screen 114 may be configured to filter the fluids 122 flowing into the production tubular 112 from the annulus 120. The inflow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and inflow control device 116 be positioned between a pair of packers 118. Nor is it necessary for a single inflow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Figure 2:
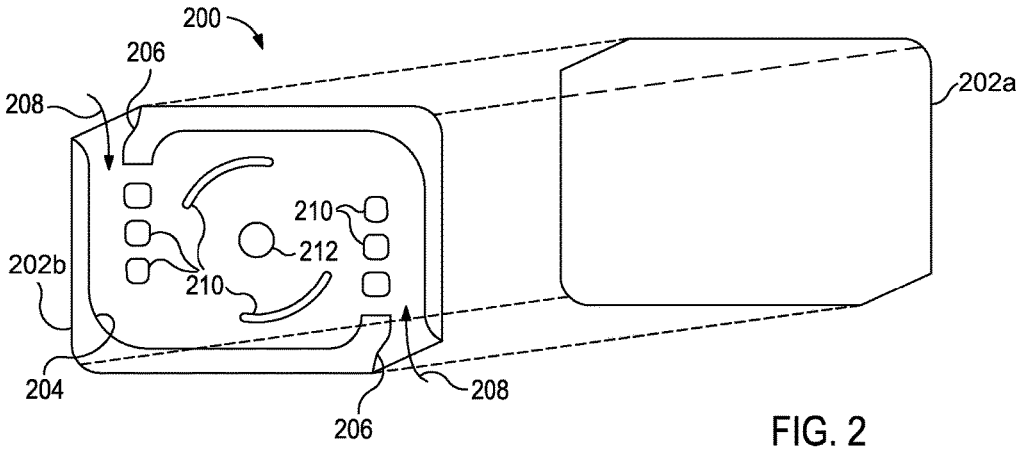
FIG. 2 illustrates an exploded top view of an exemplary autonomous inflow control device, according to one or more embodiments.

Referring now to FIG. 2, with continued reference to FIG. 1, illustrated is an exploded top view of an exemplary autonomous inflow control device 200, according to one or more embodiments. The autonomous inflow control device 200 (hereafter "AICD 200") may be any one of the flow control devices 116 shown in FIG. 1 and otherwise form part of an autonomous inflow control device (AICD) assembly. The AICD 200 may be made of, for example, tungsten carbide, but may be made of any other materials known to those skilled in the art. As illustrated, the AICD 200 may include a top plate 202*a* and a bottom plate 202*b*. The top plate 202*a* may be configured to be coupled or otherwise secured to the bottom plate 202*b* in order to define a flow chamber 204 therebetween within the AICD 200. The top plate 202*a* may be coupled to the bottom plate 202*b* using a variety of techniques including, but not limited to, mechanical fasteners, adhesives, welding, brazing, heat shrinking, combinations thereof and the like.

The bottom plate 202*b* may define one or more fluid inlets 206 (two shown) that provide fluid access into the flow chamber 204. While two fluid inlets 206 are depicted in FIG. 2, those skilled in the art will readily recognize that the AICD 200 is shown merely for illustrative purposes and other exemplary AICDs may have only one fluid inlet or more than two fluid inlets, without departing from the scope of the disclosure. The fluid inlets 206 may be configured to receive a flow of a fluid 208 therethrough and direct the fluid 208 into the flow chamber 204. The fluid 208 may be a fluid composition originating from a surrounding formation 108 (FIG. 1), for example, and may include one or more fluid components, such as oil and water, oil and gas, gas and water, oil, water and gas, etc.

The bottom plate 202*b* of the AICD 200 may further provide or otherwise define various internal structures 210 and an outlet 212. The AICD 200 may be configured to resist the flow of the fluid 208 therethrough based on one or more characteristics of the fluid 208, such as density, viscosity, and/or velocity of the fluid 208 or its various fluid components. More specifically, the internal structures 210 may be configured to induce spiraling of the flow of the fluid 208 about the outlet 212. As a result, the fluid 208 may be subjected to centrifugal or vortex forces that may cause various components of the fluid 208 that are more viscous to collect or otherwise congregate more rapidly at the outlet 212, while components of the fluid 208 that are less viscous to flow to the outlet 212 less rapidly. As a result, the AICD 200 may provide a greater resistance to the flow of undesired fluids (e.g., water, gas, etc.) than desired fluids (e.g., oils), particularly as the percentage of the undesired fluids increases.

Figure 3:
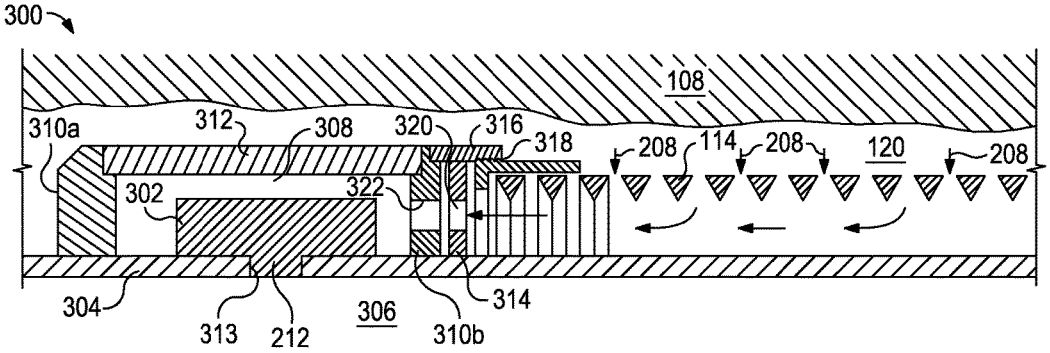
FIG. 3 illustrates an enlarged cross-sectional view of an exemplary autonomous inflow control device assembly, according to one or more embodiments.

Referring now to FIG. 3, with continued reference to FIGS. 1 and 2, illustrated is an enlarged cross-sectional view of an exemplary autonomous inflow control device assembly 300, according to one or more embodiments. As illustrated, the autonomous inflow control device assembly 300 (hereafter "AICD assembly 300") includes at least one autonomous flow control device 302 (hereafter "AICD 302"). The AICD 302 may be similar to the AICD 200 of FIG. 2 and/or may be any one of the flow control devices 116 depicted in FIG. 1. A portion of a well screen 114 is also depicted and may be operably coupled to or otherwise generally arranged about the exterior of a base pipe 304. The base pipe 304 may be or otherwise form part of the production tubing 112 of FIG. 1 and may define an interior 306 for the receipt of the fluid 208 after passing through the AICD 302.

The AICD 302 may be arranged within a fluid compartment 308 generally defined by a first end ring 310*a*, a second end ring 310*b*, a cover plate 312, and the base pipe 304. The AICD 302 may be shrink-fitted into the base pipe 304 and thereby secure the AICD 302 therein for long-term operation. More particularly, the outlet 212 of the AICD 302 may extend into and otherwise be secured within a corresponding flow port 313 defined in the base pipe 304, thereby placing the AICD 302 in fluid communication with the interior 306 of the base pipe 304. While only one AICD 302 is shown in FIG. 3, those skilled in the art will readily recognize that the AICD assembly 300 may include several flow control devices arranged about the circumference of the base pipe 304 and otherwise within the fluid compartment 308 or corresponding fluid compartments for additional AICDs.

The cover plate 312 may extend between the first and second end rings 310*a,b* and may be secured thereto in a variety of ways including, but not limited to, welding, brazing, adhesives, mechanical fasteners, combinations thereof, and the like. In at least one embodiment, the cover plate 312 may be threaded or threadably attached to at least one of the end rings 310*a,b*, thereby allowing a well operator to remove the cover plate and access the AICD 302 to make fluid flow adjustments to the AICD assembly 300 prior to downhole deployment.

According to the present disclosure, the AICD assembly 300 may further include a flow ring 314 arranged axially between the second end ring 310*b* and the well screen 114 and otherwise extending about the circumference of the base pipe 304. In some embodiments, the flow ring 314 may be secured in place and otherwise enclosed between the second end ring 310*b* and the well screen 114 with a shroud 316. The shroud 316 may be removably coupled to the second end ring 310*b* and the well screen 114 in a variety of ways. For instance, in some embodiments, the shroud 316 may be mechanically-fastened to at least one of the second end ring 310*b* and the well screen 114 using one or more mechanical fasteners (not shown). In other embodiments, as illustrated, the shroud 316 may be threaded or threadably attached to at least one of the second end ring 310*b* and the well screen 114. For example, as illustrated, a portion of the well screen 114 may define or otherwise provide a series of threads 318 configured to mate with corresponding threads defined on the shroud 316. As will be appreciated, however, the threads 318 may equally be defined on the second end ring 310*b*, or both the second end ring 310*b* and the well screen 114, without departing from the scope of the disclosure.

The flow ring 314 may be installed by the well operator on-site prior to deploying the AICD assembly 300 downhole and may be configured to generally regulate the flow of fluids 208 into the fluid compartment 308. More particularly, the well operator may access the flow ring 314 by removing (e.g., unthreading) the shroud 316. Once the well operator accesses the flow ring 314, the flow ring 314 may be manipulated, altered, replaced, removed, re-configured, or any combination thereof in order to change the fluid flow characteristics of the AICD assembly 300 during downhole operation. As discussed in greater detail below, various designs and configurations of the flow ring 314 may be selected by the well operator in order to optimize downhole production capabilities.

In exemplary operation of the AICD assembly 300, fluid 208 from the annulus 120 may be drawn through the well screen 114 and is thereby filtered before flowing toward the flow ring 314. The flow ring 314 may include one or more flow channels 320 that extend axially therethrough to convey the fluid 208 to one or more flow conduits 322 defined in the second end ring 310*b*. In some cases, the flow conduits 322 may be two or more slots defined in the second end ring 310*b* that are configured to fluidly communicate with a single fluid compartment 308. In other embodiments, the flow conduits 322 may encompass individual fluid channels that fluidly communicate with a corresponding individual fluid compartment 308.

Accordingly, the annulus 120 is placed in fluid communication with the fluid compartment 308 via the flow channels 320 defined in the flow ring 314 and the flow conduit(s) 322 defined in the second end ring 310*b*. In some embodiments, the flow channels 320 and the flow conduits 322 may be substantially axially aligned. In other embodiments, however, the flow channels 320 and the flow conduits 322 but may be angularly-offset from each other, without departing from the scope of the disclosure. Once in the fluid compartment 308, the fluid 208 may enter the AICD 302 and eventually be discharged therefrom and into the interior 306 of the base pipe 304 via the flow port(s) 313 defined in the base pipe 304.

Figure 4:
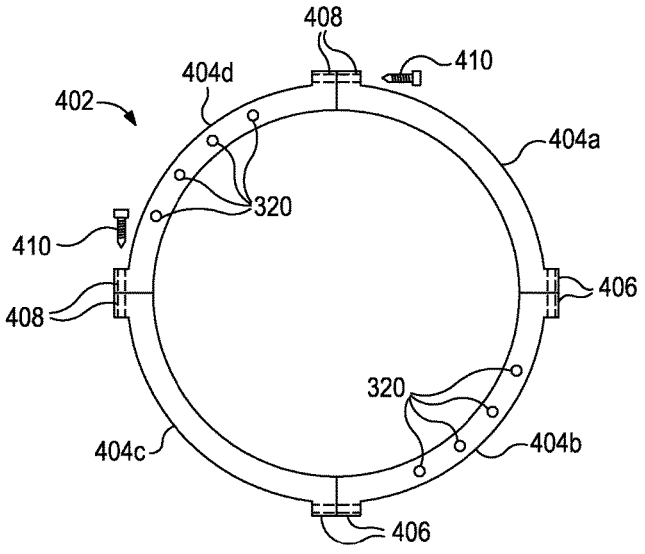
FIG. 4 illustrates an exemplary flow ring, according to one or more embodiments.

Referring now to FIG. 4, with continued reference to FIG. 3, illustrated is an exemplary flow ring 402, according to one or more embodiments. The flow ring 402 may be used in the AICD assembly 300 of FIG. 3 and otherwise able to replace the flow ring 314. Accordingly similarly used reference numerals in the flow rings 314 and 402 indicate like elements or components that will not be described again. As with the flow ring 314 of FIG. 3, the flow ring 402 may be configured to extend about the outer surface of the base pipe 304 (FIG. 3) and otherwise interpose the second end ring 310*b* (FIG. 3) and the well screen 114 (FIG. 3).

As illustrated, the flow ring 402 may include at least two arcuate portions 404 (shown as arcuate portions 404*a*, 404*b*, 404*c*, and 404*d*) that form a ring. While four arcuate portions 404*a-d* are depicted, those skilled in the art will appreciate that more or less than four may be employed (including only two), without departing from the scope of the disclosure. Each arcuate portion 404*a-d* may be configured to be axially aligned with a corresponding fluid compartment 308 and AICD 302 of the AICD assembly 300 of FIG. 3.

In some embodiments, the arcuate portions 404*a-d* may be coupled together at their opposing ends. For example, the ends of each arcuate portion 404*a-d* may provide or otherwise define a clasping mechanism 406 configured to mate with a corresponding clasping mechanism 406 of an angularly adjacent arcuate portion 404*a-d*. In some embodiments, portions of the clasping mechanisms 406 may extend radially outward from the arcuate portions 404*a-d* and may have a channel 408 tangentially defined therethrough. Axially aligned channels 408 may be configured to receive a corresponding fastener 410 therein to couple adjacent arcuate portions 404*a-d* together. In some embodiments, the fasteners 410 may be pins or other non-threaded rod-like members that may be secured within the channels 408. In other embodiments, the fasteners 410 may be threaded into the channels 408 and tightening the fasteners 410 may serve to cinch the arcuate portions 404*a-d* together and otherwise secure the flow ring 402 to the outer surface of the base pipe 304 (FIG. 3) via an interference fit. In yet other embodiments, the shroud 316 (FIG. 3) may serve to radially bias and therefore secure the various arcuate portions 404*a-d* of the flow ring 402 in place about the outer surface of the base pipe 304 (FIG. 3), without departing from the scope of the disclosure.

As illustrated, one or more flow channels 320 may be defined in the flow ring 402. In FIG. 4, the flow channels 320 are depicted as being defined in the second and fourth arcuate portions 404*b,d*. Accordingly, the second and fourth arcuate portions 404*b,d* may be configured to allow fluid flow into corresponding fluid compartments 308 and AICDs 302 of the associated AICD assembly 300 (FIG. 3). As will be appreciated, the size (i.e., diameter) and length of each flow channel 320 may directly correspond to the potential flow rate of fluids therethrough. The first and third arcuate portions 404*a,c*, however, are depicted without flow channels 320, and therefore during operation may be configured to substantially prevent fluid flow therethrough into corresponding fluid compartments 308 and AICDs 302 of the associated AICD assembly 300.

As will be appreciated, a well operator may be able to strategically place differently sized and/or designed arcuate portions 404*a-d* of the flow ring 402 about the base pipe 304 prior to deploying the associated AICD assembly 300 downhole, and thereby intelligently regulate the flow of the fluid 208 into the base pipe 304. In some embodiments, for example, it may be desired to have all the arcuate portions 404*a-d* with flow channels 320 defined therein, and thereby maximize fluid flow production through the associated AICD assembly 300. In other embodiments, however, it may be desired to restrict the fluid flow through the AICD assembly, and therefore the well operator may decide to place one or more arcuate portions 404*a-d* without any flow channels 320. In yet other embodiments, a well operator may desire to prevent fluid flow entirely through the AICD assembly 300, and therefore may decide to use arcuate portions 404*a-d* that do not have any flow channels 320. As a result, fluid flow through the associated AICD assembly 300 may be optimized, choked, restricted, and otherwise stopped by a well operator on-site prior to deploying the AICD assembly 300 downhole.

Figure 5A:
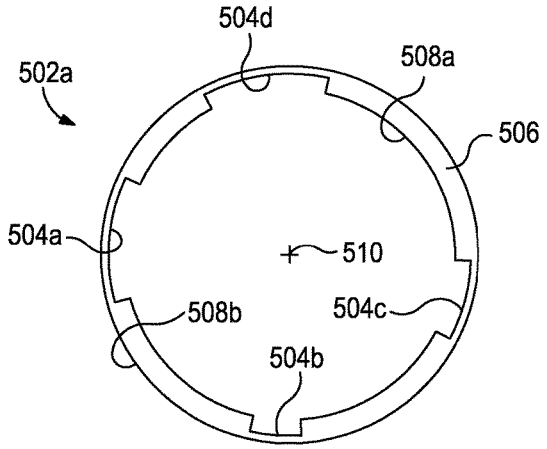
FIGS. 5A and 5B illustrate exemplary flow rings, according to one or more embodiments.
Figure 5B:
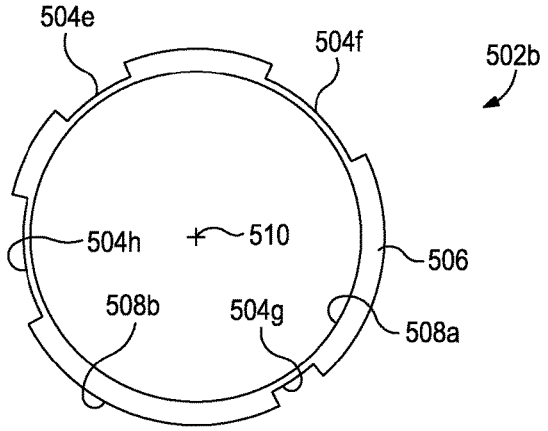

Referring now to FIGS. 5A and 5B, with continued reference to FIGS. 3 and 4, illustrated are additional exemplary flow rings 502*a* and 502*b*, according to one or more embodiments. Similar to the flow ring 402 of FIG. 4, the flow rings 502*a,b* may be used in conjunction with the AICD assembly 300 of FIG. 3 and may otherwise replace the flow ring 314 depicted therein. Moreover, similar to the flow rings 314 and 402 of FIGS. 3 and 4, the flow rings 502*a,b* may be configured to extend about the outer surface of the base pipe 304 (FIG. 3) and otherwise interpose the second end ring 310*b* (FIG. 3) and the well screen 114 (FIG. 3). Unlike the flow rings 314 and 402, however, the flow rings 502*a,b* may include one or more angular slots 504 defined therein for allowing or preventing the flow of fluids 208 (FIG. 3) toward a corresponding AICD.

The flow rings 502*a,b* may each include a body 506 that provides an inner radial surface 508*a* and an outer radial surface 508*b*. The inner radial surface 508*a* may be configured to be seated against the outer surface of the base pipe 304 when properly installed in an AICD assembly, and the outer radial surface 508*b* may engage or otherwise interact with the shroud 316 (FIG. 3) in order to secure the flow ring 502*a* in place. In other embodiments, the inner radial surface 508*a* may be configured to be seated against the outer surface of another structure, such as a portion of the second end ring 310*b* that may extend axially along the base pipe 304. In yet other embodiments, the inner radial surface 508*a* may be seated against a separate flow ring entirely, without departing from the scope of the disclosure.

In FIG. 5A, the angular slots 504 of the flow ring 502*a*, shown as angular slots 504*a*, 504*b*, 504*c*, and 504*d*, may be defined in the inner radial surface 508*a* of the body 506 and otherwise extend radially outward and toward the outer radial surface 508*b*. In some embodiments, a sealing element (not shown) may extend about the periphery of the outer radial surface 508*b* and may be configured to generate a sealed interface between the body 506 and the shroud 316 when the flow ring 502*a* is properly installed in the AICD assembly 300.

In FIG. 5B, the angular slots 504 of the flow ring 502*b*, shown as angular slots 504*e*, 504*f*, 504*g*, and 504*h*, may be defined in the outer radial surface 508*b* of the body 506 and otherwise extend radially inward and toward the inner radial surface 508*a*. In some embodiments, a sealing element (not shown) may extend about the periphery of the inner radial surface 508*a* and may be configured to generate a sealed interface between the body 506 and the outer surface of the base pipe 304 (FIG. 3) when the flow ring 502*b* is properly installed in the AICD system. Alternatively, in the event that the inner radial surface 508*a* is seated against the outer surface of another structure, such as a portion of the second end ring 310*b* that may extend axially along the base pipe 304, the sealing element may be configured to generate a sealed interface between the body 506 and said other structure.

Similar to the flow channels 320 of the flow rings 314 and 402, the angular slots 504*a-h* may be configured to allow fluid flow into corresponding fluid compartments 308 and AICDs 302 of the associated AICD assembly 300 when properly aligned with the corresponding flow conduits 322 (FIG. 3). However, portions of the body 506 where the angular slots 504*a-h* are not provided may serve to substantially prevent fluid flow therethrough into corresponding fluid compartments 308 and AICDs 302 of the associated AICD assembly 300 when aligned with the corresponding flow conduits 322.

To this end, the angular slots 504*a-h* may exhibit varying sizes (e.g., angular length) and depths (e.g., radial distance of open space from the inner or outer radial surface 508*a,b*) in order to fit the needs of particular well applications. For instance, some fluid compartments 308 are fed by multiple flow conduits 322 that are angularly offset from each other in the second end ring 310*b*. In such embodiments, an angular slot 504*a-h* may be sized and otherwise designed to angularly span the multiple flow conduits 322 in order to provide a fully open fluid flow into the corresponding fluid compartment 308. In other embodiments, it may be desirable to limit the fluid flow into a particular fluid compartment 308. In such cases, an angular slot 504*a-h* may be sized and otherwise designed to span only a portion of the multiple flow conduits 322 in order to provide a restricted amount of fluid flow into the corresponding fluid compartment 308.

According to the present disclosure, prior to deployment of the AICD assembly 300 downhole, the flow rings 502*a,b* may be accessed by a well operator on-site and adjusted to intelligently regulate the flow of the fluid 208 into the base pipe 304. To accomplish this, the shroud 316 may be removed, as generally described above, and the well operator may rotate the flow rings 502*a,b* about a central axis 510 to a desired angular configuration where the angular slots 504*a-h* align (or misalign) with the flow conduits 322 of the various fluid compartments 308 of the AICD assembly 300. Once the desired angular configuration is attained, in at least one embodiment, the well operator may rotationally secure the flow rings 502*a,b* in place using one or more retaining mechanisms (not shown) such as, but not limited to, set screws, dowels, snap rings, and the like. In other embodiments, the flow rings 502*a,b* may be rotationally secured upon reattaching the shroud 316, and thereby generating an interference fit between the outer radial surface 508*b* of the flow rings 502*a,b* and the inner wall of the shroud 316. Rotating the flow rings 502*a,b* to desired angular configurations prior to deployment may prove advantageous in providing desired production needs and/or capabilities for a particular well, and thereby allowing a well operator to alter the flow characteristics of the AICD assembly 300 on-site.

Figure 6:
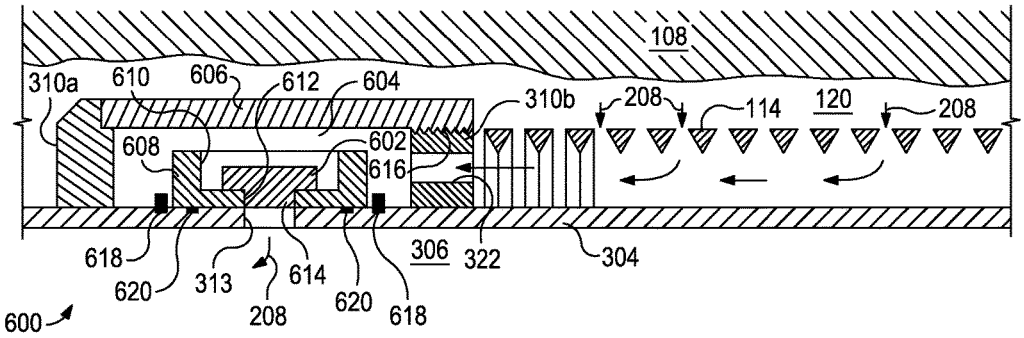
FIG. 6 illustrates an enlarged cross-sectional view of another exemplary autonomous inflow control device assembly, according to one or more embodiments.

Referring now to FIG. 6, with continued reference to FIG. 3, illustrated is an enlarged cross-sectional view of another exemplary autonomous inflow control device assembly 600, according to one or more embodiments. The autonomous inflow control device assembly 600 (hereafter "AICD assembly 600") may be similar in some respects to the AICD 300 of FIG. 3 and therefore may be best understood with reference thereto, where like numerals correspond to like components not described again. As illustrated, the AICD assembly 600 includes at least one autonomous flow control device 602 (hereafter "AICD 602"). The AICD 602 may be similar to the AICD 200 of FIG. 2, and therefore will not be described again in detail.

The AICD 602 may be arranged within a fluid compartment 604 generally defined by the first end ring 310*a*, the second end ring 310*b*, the base pipe 304, and a cover plate 606. The AICD 602 may be shrink-fitted into a flow ring 608 that is movably or rotatably arranged within the fluid compartment 604. More particularly, the flow ring 608 may define or otherwise provide a cavity 610 and a flow channel 612, and the AICD 602 may be configured to be arranged within the cavity 610 such that an outlet 614 of the AICD 602 is able to be shrink-fitted or otherwise secured within the flow channel 612. In some embodiments, as will be appreciated, the cavity 610 may be omitted or otherwise reduced in size and the AICD 602 may nonetheless be secured within the flow channel 612 in order to secure the AICD 602 to the flow ring 608 for movement therewith. Again, as with prior embodiments, while only one AICD 602 is shown in FIG. 6, those skilled in the art will readily recognize that the AICD assembly 600 may include several AICDs arranged about the circumference of the base pipe 304 and otherwise coupled to the flow ring 608 at various circumferential locations, as described above.

The cover plate 606 may extend between the first and second end rings 310*a,b* and generally provide a removable sleeve for accessing the fluid compartment 604, the AICD 602, and the flow ring 608. The cover plate 606 may be coupled to at least one of the end rings 310*a,b* in a variety of ways. For instance, in some embodiments, the cover plate 606 may be mechanically-fastened to at least one of the first and second end rings 310*a,b* using one or more mechanical fasteners (not shown). In other embodiments, the cover plate 606 may be threaded or threadably attached to at least one of the end rings 310*a,b*. For example, as illustrated, the second end ring 310*b* may define or otherwise provide a series of threads 616 configured to mate with corresponding threads defined on the cover plate 606. As will be appreciated, however, the threads 616 may equally be defined on the first end ring 310*a*, or both the first and second end rings 310*a,b*, without departing from the scope of the disclosure.

The flow ring 608 may be axially secured within the fluid compartment 604 with radial shoulders 618 disposed at opposing axial ends of the flow ring 608. In some embodiments, one or both of the radial shoulders 618 may be structural shoulders defined on and otherwise extending radially from the base pipe 304. In other embodiments, the one or both of the radial shoulders 618 may be a snap ring, or the like. One or more sealing elements 620 (two shown) may also be arranged between the base pipe 304 and the flow ring 608 in order to generate a sealed interface therebetween. The sealing elements 620 may be O-rings, for example, or any other type of sealing device known to those skilled in the art.

With the AICD 602 secured within the flow channel 612, the flow ring 608 may be configured to be rotated in order to radially align the outlet 614 of the AICD 602 with one of the flow ports 313 defined in the base pipe 304. In order to do this, a well operator may access the fluid compartment 604 by decoupling the cover plate 606 from one or both of the first and second end rings 310*a,b*, and then subsequently removing it. With the fluid compartment 604 exposed, the well operator may then be able to manually rotate the flow ring 608 to a desired angular orientation in order radially align the outlets 614 of the various AICDs 602 included in the AICD assembly 600 with corresponding flow ports 613 of the base pipe. As the flow ring 608 rotates, the radial shoulders 618 maintain the axial position of the flow ring 608 and the sealing elements 620 provide a sealed interface on either axial side of the flow channels 612.

Figure 6A:
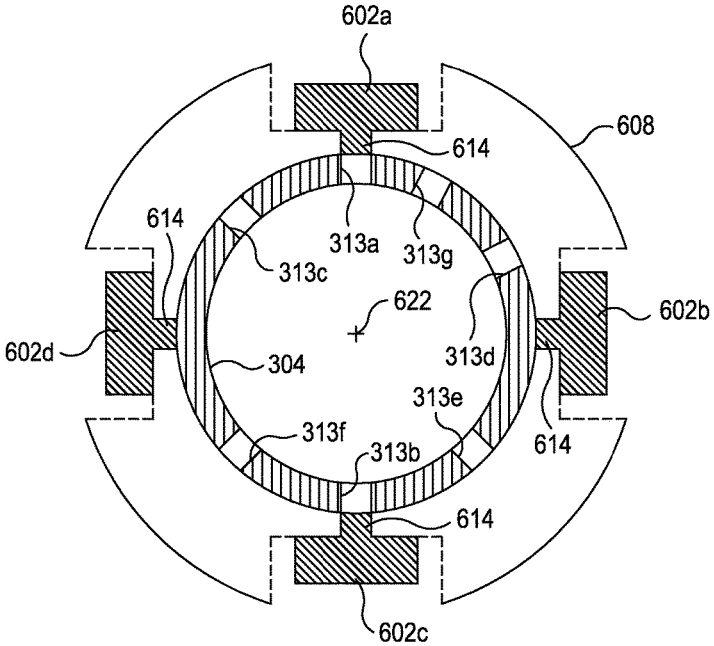
FIG. 6A illustrates a cross-sectional view of the rotatable flow ring as arranged about the base pipe, according to one or more embodiments

Referring to FIG. 6A, with continued reference to FIG. 6, illustrated is a cross-sectional view of the exemplary rotatable flow ring 608 as arranged about the base pipe 304, according to one or more embodiments. Several AICDs 602 (shown as AICDs 602*a*, 602*b*, 602*c*, and 602*d*) may be secured to the flow ring 608, as generally described above, and otherwise form part of the AICD assembly 600. As illustrated, the base pipe 304 may include a plurality of flow ports 313 (shown as flow ports 313*a*, 313*b*, 313*c*, 313*d*, 313*e*, 313*f*, and 313*g*) strategically defined in the base pipe 304 at known angular locations or orientations. The AICDs 602*a-d* may be angularly spaced about the periphery of the base pipe 304 and otherwise arranged in the flow ring 608 such that they are able to radially align in various configurations with the flow ports 313*a-g* based on the known locations of the flow ports 313*a-g*.

To accomplish this, the flow ring 608 may be rotated about a central axis 622 in order to radially align the outlets 614 of one or more of the AICDs 602*a-d* with a corresponding one or more of the flow ports 313*a-g*. For instance, if it is desired that the AICD assembly 600 exhibit moderate fluid flow characteristics, the flow ring 608 may be rotated such that the first and second flow ports 313*a* and 313*b* are radially aligned simultaneously with two of the AICDs 602*a* and 602*c*, as illustrated, while occluding the outlets 614 corresponding to the remaining two AICDs 602*b* and 602*d*. Alternatively, if it is desired that the AICD assembly 600 exhibit maximum fluid flow characteristics, the flow ring 608 may be rotated such that the third, fourth, fifth, and sixth flow ports 313*c-f* are radially aligned simultaneously with each of the AICDs 602*a-d*, respectively. Moreover, if it is desired that the AICD assembly 600 exhibit minimum fluid flow characteristics, the flow ring 608 may be rotated such that the seventh flow port 313*g* is radially aligned with one of the AICDs 602*a-d*, while the outlets 314 to the remaining AICDs 602*a-d* are occluded. Lastly, if it is desired that the AICD assembly 600 prevent or stop fluid flow therethrough, the flow ring 608 may be rotated such that the none of the AICDs 602*a-d* radially align with the flow ports 313*a-g*.

As can be appreciated, the particular design and configuration of the AICDs 602*a-d*, the flow ring 608, and the flow ports 313*a-g* defined in the base pipe 304 are shown in FIG.

6A merely for illustrative purposes and should not be considered limiting to the present disclosure. For instance, in some embodiments it may be desired to align any number of the AICDs 602*a-d* with a corresponding number of flow ports 313*a-g*, such as aligning three AICDs 602*a-d* with three corresponding flow ports 313*a-g*. Those skilled in the art will readily appreciate that several variations of the design and configuration of the AICDs 602*a-d*, the flow ring 608, and the flow ports 313*a-g* may equally be employed in the AICD assembly 600, without departing from the scope of the disclosure. For instance, it embodiments are also contemplated herein where there are more or less than four AICDs 602*a-d* and more or less than seven flow ports 313*a-g*.

Those skilled in the art will also readily appreciate the advantages that the flow ring 608 may provide a well operator on-site. For instance, the AICD assembly 600 may arrive at a well site with a particular manufacturer design applied thereto corresponding to predetermined flow characteristics or capabilities. According to the present disclosure, the well operator may be able to access the flow ring 608 on-site, as generally described above, and adjust the flow capabilities of the AICD assembly 600 prior to downhole deployment, and thereby undertake on-site field adjustments to the amount of fluid being introduced into the base pipe 304 during operation. Once the desired on-site fluid flow adjustments have been made, the AICD assembly 600 may then be deployed downhole for operation.

Figure 7:
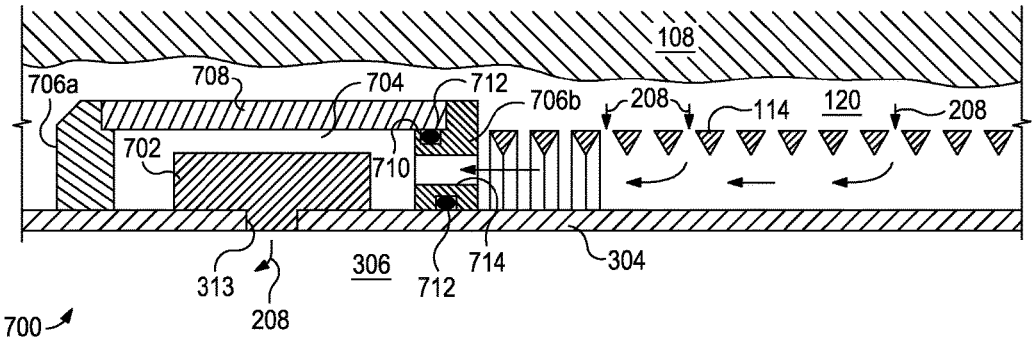
FIG. 7 illustrates an enlarged cross-sectional view of another exemplary autonomous inflow control device assembly, according to one or more embodiments.

Referring now to FIG. 7, with continued reference to FIG. 3, illustrated is an enlarged cross-sectional view of another exemplary autonomous inflow control device assembly 700, according to one or more embodiments. The autonomous inflow control device assembly 700 (hereafter "AICD assembly 700") may be similar in some respects to the AICD assembly 300 of FIG. 3 and therefore may be best understood with reference thereto, where like numerals correspond to like components not described again. As illustrated, the AICD assembly 700 includes at least one autonomous flow control device 702 (hereafter "AICD 702"), and the AICD 702 may be similar to the AICD 200 of FIG. 2 and therefore will not be described again in detail.

The AICD 702 may be arranged within a fluid compartment 704 generally defined by a first end ring 706*a*, a second end ring 706*b*, a cover plate 708, and the base pipe 304. The AICD 702 may be shrink-fitted into a corresponding flow port 313 of the base pipe 304, as generally described above. Again, as with prior embodiments, while only one AICD 702 is shown in FIG. 7, those skilled in the art will readily recognize that the AICD assembly 300 may include several AICDs arranged about the circumference of the base pipe 304 and otherwise within the fluid compartment 704 or corresponding fluid compartments provided for additional AICDs.

The cover plate 708 may extend between the first and second end rings 706*a,b* and may be coupled to the first end ring 706*a* in a variety of ways including, but not limited to, welding, brazing, adhesives, mechanical fasteners, threading combinations thereof, and the like. The cover plate 708, however, may be movably or slidingly coupled to the second end ring 706*b*. More particularly, the second end ring 706*b* may provide or define a shoulder 710 configured to receive or otherwise seat the end of the cover plate 708. One or more sealing elements 712 (one shown) may be arranged between the shoulder 710 and the cover plate 708, thereby generating a sealed interface at that location. One or more additional sealing elements 712 (one shown) may also be arranged between the base pipe 304 and the second end ring 706*b*, thereby generating a sealed interface at that location.

The second end ring 706*b* may be rotatably mounted to the base pipe 304 and otherwise able to be rotationally manipulated by a well operator on-site prior to deployment of the AICD assembly 700 downhole. Accordingly, the second end ring 706*b* may serve or otherwise operate as a flow ring for the fluid compartment 704, as generally described herein, and any other fluid compartments arranged about the periphery of the base pipe 304. As illustrated, the flow ring/second end ring 706*b* may include one or more flow channels 714 that extend axially therethrough to convey the fluid 208 into axially adjacent fluid compartment(s) 704. In some embodiments, the flow channels 714 may be angular slots defined in the flow ring/second end ring 706*b* for allowing or preventing the flow of fluids 208 toward the corresponding AICD 702.

Figure 7A:
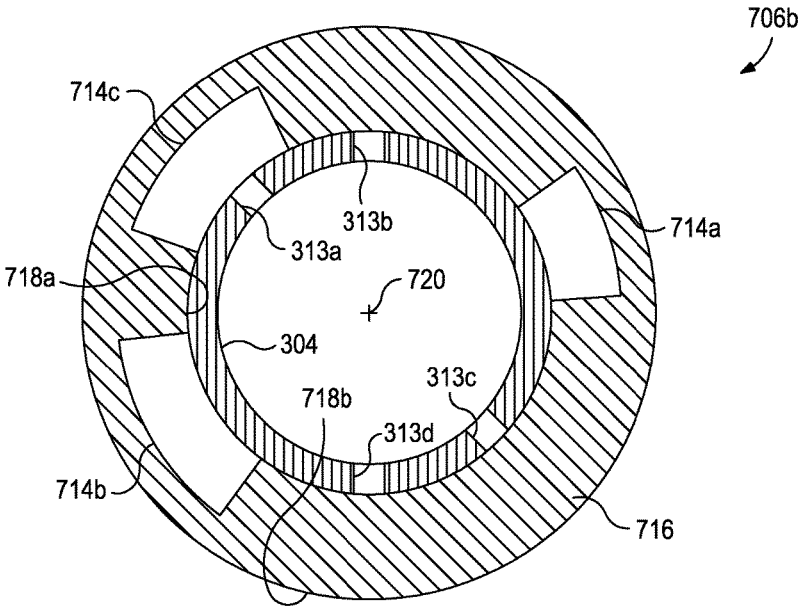
FIG. 7A illustrates a cross-sectional view of an exemplary flow ring, according to one or more embodiments.

Referring now to FIG. 7A, with continued reference to FIG. 7, illustrated is an exemplary embodiment of the flow ring/second end ring 706*b* of FIG. 7, according to one or more embodiments. As illustrated, the flow ring/second end ring 706*b* (hereafter "flow ring 706*b*") may include a body 716 that provides an inner radial surface 718*a* and an outer radial surface 718*b*. The inner radial surface 718*a* may be configured to be seated against the outer surface of the base pipe 304 when properly installed in the AICD assembly 700. The base pipe 304 may include a plurality of flow ports 313 (shown as flow ports 313*a*, 313*b*, 313*c*, and 313*d*) strategically defined in the base pipe 304 at known angular locations or orientations. The flow channels 714, shown as flow channels 714*a*, 714*b*, and 714*c*, may be angularly spaced about the periphery of the base pipe 304 and otherwise arranged so as to axially align with one or more fluid compartments 704 of the AICD assembly 700.

The flow channels 714*a-c* may be defined in the inner radial surface 718*a* of the body 716 and otherwise extend radially outward and toward the outer radial surface 718*b*. The flow channels 714*a-c* may be configured to allow fluid flow into corresponding fluid compartments 704 and AICDs 702 of the associated AICD assembly 700 (FIG. 7) when properly aligned with the fluid compartments 704. On the contrary, portions of the body 716 where the flow channels 714*a-c* are not provided may serve to substantially prevent fluid flow therethrough into corresponding fluid compartments 704 and AICDs 702 of the associated AICD assembly 700 when aligned with the corresponding flow conduits 322.

The flow channels 714*a-c* may exhibit varying sizes (e.g., angular length) and depths (e.g., radial distance of open space from the inner surface 718*a*) in order to fit the needs of particular well applications. For instance, a flow channel 714*a-c* may be sized and otherwise designed to angularly span all or a portion of one or more fluid compartments 704. In other embodiments, a flow channel 714*a-c* may be sized and otherwise designed to span only a portion of a fluid compartment 704.

According to the present disclosure, prior to deployment of the AICD assembly 700 downhole, the flow ring 706*b* may be manually rotated about a central axis 720 by a well operator on-site with respect to the base pipe 304. As the flow ring 706*b* is rotated, the sealing elements 712 (FIG. 7) may maintain a fluid seal, as described above. The well operator may rotate the flow ring 706*b* about the central axis 720 to a desired angular configuration where the flow channels 714*a-c* align (or misalign) with the various fluid compartments 704 of the AICD assembly 700. Once the desired angular configuration is attained, in at least one embodiment, the well operator may rotationally secure the flow ring 706*b* in place using one or more retaining mechanisms (not shown) such as, but not limited to, set screws, dowels, snap rings, and the like. As will be appreciated, rotating the flow ring 706*b* to desired angular configurations prior to deployment may prove advantageous in providing desired production needs and/or capabilities for a particular well, and thereby allowing a well operator to alter the flow characteristics of the AICD assembly 700 on-site.

As can also be appreciated, the particular design and configuration of the flow ring 706*b* and its associated flow channels 714*a-c* are shown in FIG. 7A merely for illustrative purposes and should not be considered limiting to the present disclosure. Those skilled in the art will readily appreciate that several variations of the design and configuration of the flow ring 706*b* may equally be employed in the AICD assembly 700, without departing from the scope of the disclosure. For instance, it embodiments are also contemplated herein where there are more or less than three flow channels 714*a-c*, or where the sizes of the flow channels 714*a-c* are altered.

Those skilled in the art will also readily appreciate the advantages that the flow ring 706*b* may provide a well operator on-site. For instance, the AICD assembly 700 may arrive at a well site with a particular manufacturer design applied thereto corresponding to predetermined flow characteristics or capabilities. According to the present disclosure, the well operator may be able manually rotate the flow ring 706*b* on-site, as generally described above, and adjust the flow capabilities of the AICD assembly 700 prior to downhole deployment, and thereby undertake on-site field adjustments to the amount of fluid being introduced into the base pipe 304 during operation. Once the desired on-site fluid flow adjustments have been made, the AICD assembly 700 may then be deployed downhole for operation.

Embodiments disclosed herein include:

A. An autonomous inflow control device (AICD) assembly that includes a base pipe defining one or more flow ports and an interior, a first end ring and a second end ring each arranged about the base pipe, the second end ring being axially-offset from the first end ring such that a fluid compartment is defined therebetween, an AICD arranged within the fluid compartment and having at least one fluid inlet and an outlet configured to be in fluid communication with one of the one or more flow ports, and a flow ring arranged about the base pipe and in fluid communication with the AICD, the flow ring being operable to regulate a fluid flow into the interior of the base pipe and being accessible and manipulatable by a well operator on-site.

B. A method that includes receiving an autonomous inflow control device (AICD) assembly subsequent to its manufacture, the AICD assembly comprising a base pipe defining one or more flow ports and an interior, a first end ring and a second end ring each arranged about the base pipe, wherein the second end ring is axially-offset from the first end ring such that a fluid compartment is defined therebetween, and an AICD arranged within the fluid compartment and having at least one fluid inlet and an outlet configured to be in fluid communication with one of the one or more flow ports, accessing and manipulating a flow ring while on-site in order to regulate a fluid flow into the interior of the base pipe, the flow ring being arranged about the base pipe and in fluid communication with the AICD, and deploying the AICD assembly into a wellbore.

Each of embodiments A and B may have one or more of the following additional elements in any combination: Element 1: further comprising a well screen extending axially from the second end ring, wherein the flow ring is arranged axially between the second end ring and the well screen, and a shroud that extends between the second end ring and the well screen and covers the flow ring. Element 2: wherein the shroud is at least one of mechanically-fastened and threaded to at least one of the well screen and the second end ring, thereby making the flow ring accessible by the well operator. Element 3: wherein the flow ring defines one or more flow channels and the second end ring defines one or more flow conduits, the flow ring being configured to convey a fluid through the one or more flow channels and to the fluid compartment via the one or more flow conduits. Element 4: wherein the flow ring comprises two or more arcuate portions coupled at opposing ends to form a ring. Element 5: wherein the two or more arcuate portions include a clasping mechanism configured to join the two or more arcuate portions at the opposing ends and simultaneously secure the flow ring to the base pipe. Element 6: wherein at least one of the two or more arcuate portions does not include the one or more flow conduits. Element 7: wherein the flow ring defines one or more angular slots and the second end ring defines one or more flow conduits, the flow ring being configured to convey a fluid through the one or more angular slots and to the fluid compartment via the one or more flow conduits. Element 8: wherein the flow ring is angularly rotatable about a central axis so that the well operator is able to change an angular orientation of the one or more angular slots with respect to the one or more flow conduits. Element 9: wherein the flow ring is rotatably arranged within the fluid compartment and provides at least one flow channel configured to receive and secure the outlet of the AICD therein, the AICD assembly further comprising a cover plate extending between the first and second end rings, the cover plate being removable by a well operator on-site in order to access the fluid compartment and rotate the fluid ring. Element 10: wherein the cover plate is at least one of mechanically-fastened and threaded to at least one of the first and second end rings. Element 11: wherein the flow ring is angularly rotatable by the well operator with respect to the base pipe in order to radially align or misalign the outlet of the AICD with the one of the one or more flow ports. Element 12: wherein the second end ring is the flow ring rotatably mounted to the base pipe and defining one or more flow channels therethrough to fluidly communicate with the fluid compartment, the AICD assembly further comprising a cover plate extending between the first end ring and the flow ring and allowing the flow ring to rotate with respect to the base pipe in order to angularly align or misalign the one or more flow channels with the fluid compartment. Element 13: wherein the one or more flow channels defined in the flow ring are angular slots.

Element 14: wherein accessing and manipulating the flow ring while on-site comprises removing a shroud that extends between the second end ring and a well screen and thereby uncovering the flow ring. Element 15: wherein removing the shroud comprises at least one of removing one or more mechanical fasteners and unthreading the shroud from at least one of the well screen and the second end ring. Element 16: wherein the flow ring defines one or more flow channels and the second end ring defines one or more flow conduits, the method further comprising axially aligning or misaligning the one or more flow channels and the one or more flow conduits. Element 17: wherein the flow ring comprises two or more arcuate portions and a clasping mechanism defined at opposing ends of each of the two or more arcuate portions, the method further comprising joining the two or more arcuate portions at the opposing ends with the clasping mechanism, and securing the flow ring to the base pipe.

Element 18: wherein the flow ring defines one or more angular slots and the second end ring defines one or more flow conduits, the method further comprising angularly rotating the flow ring about a central axis, and axially aligning or misaligning the one or more angular slots and the one or more flow conduits. Element 19: wherein the flow ring is rotatably arranged within the fluid compartment and provides at least one flow channel configured to receive and secure the outlet of the AICD therein, and wherein accessing and manipulating a flow ring while on-site further comprises removing a cover plate extending between the first and second end rings and thereby exposing the fluid compartment, angularly rotating the flow ring about a central axis with respect to the base pipe, and radially aligning or misaligning the outlet of the AICD with the one of the one or more flow ports. Element 20: wherein the second end ring is the flow ring rotatably mounted to the base pipe and defining one or more flow channels therethrough to fluidly communicate with the fluid compartment, and wherein accessing and manipulating the flow ring while on-site further comprises angularly rotating the flow ring about a central axis with respect to the base pipe, and axially aligning or misaligning the one or more flow channels with the fluid compartment.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An autonomous inflow control device (AICD) assembly, comprising:

a base pipe defining one or more flow ports and an interior;

a first end ring, and a second end ring defining one or more flow conduits extending axially therethrough, each of the first and second end rings arranged about the base pipe, the second end ring being axially offset from the first end ring such that a fluid compartment is defined therebetween;

an AICD arranged within the fluid compartment and having at least one fluid inlet and an outlet configured to be in fluid communication with one of the one or more flow ports; and a flow ring defining one or more flow channels extending axially therethrough, the one or more flow channels selectively restricting a fluid flow, the flow ring being arranged about the base pipe and in fluid communication with the AICD, the flow ring being operable to regulate the fluid flow into the interior of the base pipe, and being accessible and manipulatable by a well operator on-site;

a shroud that extends from the second end ring and covers the flow ring, the shroud being removable thereby making the flow ring accessible by the well operator for rotation of the flow ring to selectively align or misalign the one or more channels of the flow ring with the AICD to create a desired amount of restriction to flow therethrough during fluid production.

2. The AICD assembly of claim 1, further comprising:

a well screen extending axially from the second end ring, wherein the flow ring is arranged axially between the second end ring and the well screen; and the shroud extends between the second end ring and the well screen and covers the flow ring.

3. The AICD assembly of claim 2, wherein the shroud is at least one of mechanically-fastened and threaded to at least one of the well screen and the second end ring, thereby making the flow ring accessible by the well operator.

4. The AICD assembly of claim 2, wherein the flow ring is configured to convey a fluid through the one or more flow channels and to the fluid compartment via the one or more flow conduits.

5. The AICD assembly of claim 4, wherein the flow ring comprises two or more arcuate portions coupled at opposing ends to form a ring.

6. The AICD assembly of claim 5, wherein the two or more arcuate portions include a clasping mechanism configured to join the two or more arcuate portions at the opposing ends and simultaneously secure the flow ring to the base pipe.

7. The AICD assembly of claim 5, wherein at least one of the two or more arcuate portions does not include the one or more flow conduits.

8. The AICD assembly of claim 2, wherein the one or more flow channels are one or more angular slots, the flow ring being configured to convey a fluid through the one or more angular slots and to the fluid compartment via the one or more flow conduits.

9. The AICD assembly of claim 8, wherein the flow ring is angularly rotatable about a central axis so that the well operator is able to change an angular orientation of the one or more angular slots with respect to the one or more flow conduits.

10. A method, comprising:

receiving an autonomous inflow control device (AICD) assembly subsequent to its manufacture, the AICD assembly comprising:

a base pipe defining one or more flow ports and an interior;

a first end ring, and a second end ring defining one or more flow conduits extending axially therethrough, each of the first and second end rings arranged about the base pipe, wherein the second end ring is axially offset from the first end ring such that a fluid compartment is defined therebetween; and an AICD arranged within the fluid compartment and having at least one fluid inlet and an outlet configured to be in fluid communication with one of the one or more flow ports;

accessing and manipulating a flow ring while on-site in order to regulate a fluid flow into the interior of the base pipe, the flow ring defining one or more flow channels extending axially therethrough, the one or more flow channels selectively restricting the fluid flow, and being arranged about the base pipe and in fluid communication with the AICD, wherein accessing and manipulating the flow ring while on-site comprises removing a shroud that extends between the second end ring and a well screen and thereby uncovering the flow ring, and rotating the flow ring to selectively align or misalign the one or more flow channels with the one or more flow conduits to create a desired amount of restriction to flow therethrough during fluid production; and deploying the AICD assembly into a wellbore.

11. The method of claim 10, wherein removing the shroud comprises at least one of removing one or more mechanical fasteners and unthreading the shroud from at least one of the well screen and the second end ring.

12. The method of claim 10, wherein the flow ring comprises two or more arcuate portions and a clasping mechanism defined at opposing ends of each of the two or more arcuate portions, the method further comprising:

joining the two or more arcuate portions at the opposing ends with the clasping mechanism; and securing the flow ring to the base pipe.

13. The method of claim 10, wherein the one or more flow channels are one or more angular slots.

14. An autonomous inflow control device (AICD) assembly, comprising:

a base pipe comprising one or more flow ports and an interior;

a first end ring, and a second end ring, each of the first and second end rings arranged about the base pipe, the second end ring being axially offset from the first end ring such that a fluid compartment is defined therebetween;

an AICD arranged within the fluid compartment and having at least one fluid inlet and an outlet configured to be in fluid communication with one of the one or more flow ports; wherein the second end ring is a flow ring rotatably mounted to the base pipe and defining one or more flow channels therethrough to fluidly communicate with the fluid compartment, the one or more flow channels selectively restricting a fluid flow, and a cover plate extending between the first end ring and the flow ring, the cover being removable thereby making the flow ring accessible by a well operator on-site and allowing the flow ring to be rotated with respect to the base pipe by the operator in order to angularly align or misalign the one or more flow channels with the fluid compartment to create a desired amount of restriction to flow therethrough during fluid production.

15. The AICD assembly of claim 14, wherein the one or more flow channels defined in the flow ring are angular slots.

* * * * *